US011788268B2

(12) United States Patent
Ishimi et al.

(10) Patent No.: US 11,788,268 B2
(45) Date of Patent: Oct. 17, 2023

(54) FLUSH TOILET

(71) Applicant: TOTO LTD., Kitakyushu (JP)

(72) Inventors: Wataru Ishimi, Kitakyushu (JP); Seiya Nakashima, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/680,086

(22) Filed: Feb. 24, 2022

(65) Prior Publication Data

US 2022/0275624 A1 Sep. 1, 2022

(30) Foreign Application Priority Data

Feb. 26, 2021 (JP) ..... 2021-030149

(51) Int. Cl.
*E03D 11/08* (2006.01)

(52) U.S. Cl.
CPC ..... *E03D 11/08* (2013.01)

(58) Field of Classification Search
CPC ..... E03D 11/08
USPC ..... 4/420
See application file for complete search history.

(56) References Cited

U.S. PATENT DOCUMENTS 10,378,195 B2 * 8/2019 Urata ..... E03D 11/08
2006/0005310 A1 * 1/2006 Nakamura ..... E03D 11/08 4/420
2015/0152628 A1 * 6/2015 Hirai ..... E03D 3/00 4/420
2015/0275494 A1 * 10/2015 Kashirajima ..... E03D 11/02 4/420
2017/0260730 A1 9/2017 Kashirajima et al.
2020/0378102 A1 * 12/2020 Momoe ..... E03D 11/08

FOREIGN PATENT DOCUMENTS

JP 2017-020213 A 1/2017
JP 2017-160671 A 9/2017
JP 2017-206958 A 11/2017
JP 3321438 A1 5/2018
JP 2019-049118 A 3/2019
JP 2019-108767 A 7/2019
JP 2020-026699 A 2/2020
(Continued)

OTHER PUBLICATIONS

JP-2020026699-A Machine Translation (Year: 2022).*
(Continued)

*Primary Examiner* — David P Angwin
*Assistant Examiner* — William R Klotz
(74) *Attorney, Agent, or Firm* — Studebaker & Brackett PC

(57) ABSTRACT

A flush toilet which is capable of suppressing reduction in the force of water and disturbance in the flow curved by a pressure loss caused by a flow curved separating from a surface on an inner side portion side of an intermediate part. A rim water passage of the flush toilet includes a curved portion that is curved inward from a downstream end of an outer side portion. The curved portion includes a top portion that is at a position farthest from the intermediate part in the top view, in a direction extending the intermediate part. The top portion is formed in more the outer side portion side than a virtual center line that extends along a center of the intermediate part.

3 Claims, 6 Drawing Sheets

(56) References Cited

FOREIGN PATENT DOCUMENTS

JP 2020026699 A * 2/2020

OTHER PUBLICATIONS

"Decision to Grant a Patent" Office Action issued in JP 2021-030149; mailed by the Japanese Patent Office dated Oct. 11, 2022.
"Notice of Reasons for Refusal" Office Action issued in JP 2021-030149; mailed by the Japanese Patent Office dated Jul. 19, 2022.
An Office Action mailed by the Japanese Patent Office dated Jul. 19, 2022, which corresponds to Japanese Patent Application No. 2021-030149 and is related to U.S. Appl. No. 17/680,086.

* cited by examiner

FLUSH TOILET

CROSS-REFERENCE TO RELATED APPLICATION

This application claims benefit of priority to Japanese Patent Application No. 2021-030149, filed Feb. 26, 2021, the entire content of which is incorporated herein by reference.

BACKGROUND

Technical Field

The present disclosure relates to a flush toilet, and more particularly, to a flush toilet for discharging waste with flush water supplied from a flush water supply source.

Background Art

Conventionally, as described in Japanese Patent Laid-Open No. 2017-160671 and Japanese Patent Laid-Open No. 2017-206958, there are known flush toilets where a rim water passage is formed inside a rim portion, the rim water passage including an outer side portion that extends forward inside the rim portion, a curved portion that bends inward from the outer side portion, and an inner side portion that extends rearward from the curved portion. Flush water is guided to a rim spout port portion on a downstream side of the rim water passage and the flush water that is guided to the rim spout port portion is discharged rearward.

Furthermore, as described in Japanese Patent Laid-Open No. 2017-20213, there is known a flush toilet where a left water passageway of a water passage section is formed inside a rim portion and a returning portion is formed on the left water passageway, and where flush water that is returned by the returning portion is discharged from a second spouting port.

SUMMARY

However, with the flush toilets as described in Japanese Patent Laid-Open No. 2017-160671 and Japanese Patent Laid-Open No. 2017-206958 described above, when the flush water flowing forward inside the rim portion is relatively sharply curved to flow of the flush water flowing backward, the flow curved is separated from a surface, on the inner side portion side, of an intermediate part between the outer side portion and the inner side portion to cause a pressure loss, and problems such as reduction in the force of water and disturbance in the flow may be caused. Furthermore, with the flush toilet as described in Japanese Patent Laid-Open No. 2017-20213, the returning portion is disposed facing to an outer side of a returning flow channel in the left water passageway, and thus, when the flush water flowing forward inside the rim portion is relatively sharply curved to flow of the flush water flowing backward, the flow curved is separated from an inner side surface of the returning portion to cause a pressure loss, and problems such as reduction in the force of water and disturbance in the flow may be caused.

Accordingly, an embodiment of the disclosure is aimed to provide a flush toilet in which it is possible to suppress reduction in the force of water and disturbance in the flow caused by a pressure loss caused by a flow curved separating from a surface on an inner side portion side of an intermediate part.

Therefore, an embodiment of the disclosure is a flush toilet for discharging waste with flush water supplied from a flush water supply source, the flush toilet including: a bowl including a waste receiving surface that is bowl-shaped, and a rim portion that is formed in a top edge of the waste receiving surface; a discharge conduit that is connected below the bowl to discharge waste; and a rim spout portion that discharges flush water supplied from the flush water supply source into the bowl and that forms a circulating flow inside the bowl. The rim spout portion is provided in the rim portion, on one of left and right sides of the bowl, and the rim spout portion forms a rim water passage where the flush water that is supplied flows through, and forms, on a downstream end of the rim water passage, a rim spout port portion that discharges the flush water rearward. The rim water passage includes an outer side portion that extends forward inside the rim portion, a curved portion that is curved inward from a downstream end of the outer side portion, and an inner side portion that extends rearward from the curved portion to the rim spout port portion. The curved portion includes a top portion that is at a position farthest from an intermediate part provided between the inner side portion and the outer side portion in a top view, in a direction extending the intermediate part, the top portion being formed in more the outer side portion side than a virtual center line that extends along a center of the intermediate part.

According to an embodiment of the disclosure having a configuration as described above, the rim spout portion forms, on the downstream end of the rim water passage, the rim spout port portion that discharges flush water rearward, and the rim water passage includes the outer side portion that extends forward inside the rim portion, the curved portion that is curved inward from the downstream end of the outer side portion, and the inner side portion that extends rearward from the curved portion to the rim spout port portion. On the rim water passage that faces forward and is then curved to face rearward, the curved portion includes the top portion that is at a position farthest from the intermediate part provided between the inner side portion and the outer side portion in the top view, in a direction extending the intermediate part, the top portion being formed in more the outer side portion side than the virtual center line that extends along the center of the intermediate part. Accordingly, it is possible to suppress reduction in the force of water and disturbance in the flow that are caused by occurrence of a pressure loss that is caused when a flow that is curved is separated from the surface, of the intermediate part, on the inner side portion side when the flush water flowing forward inside the rim portion is relatively sharply curved to flow backward, and it is also possible to suppress reduction in the force of flow of water discharged from the rim spout port portion into the bowl and to discharge water while adjusting the flow. Accordingly, flushing performance for the bowl may be increased in the case where flush water is discharged rearward into the bowl from the rim spout portion after passing through the rim water passage that faces forward and is then curved to face rearward.

In an embodiment of the disclosure, preferably, the top portion is formed into an arc shape in the top view. According to an embodiment of the disclosure having a configuration as described above, the top portion is formed into an arc shape in the top view, and thus, the flush water may be curved along the top portion relatively smoothly, and it is possible to better suppress reduction in the force of water and disturbance in the flow that are caused by occurrence of a pressure loss at the top portion, and it is also possible to better suppress reduction in the force of flow of water discharged from the rim spout port portion into the bowl and to discharge water while adjusting the flow. Accordingly, flushing performance for the bowl may be even more increased in the case where flush water is discharged rearward into the bowl from the rim spout portion after passing through the rim water passage that faces forward and is then curved to face rearward.

In an embodiment of the disclosure, preferably, a curvature radius of the intermediate part, at an end portion on the curved portion side, is smaller than a curvature radius of the top portion. According to an embodiment of the disclosure having a configuration as described above, the curvature radius of the intermediate part, at the end portion on the curved portion side, is smaller than the curvature radius of the top portion. Thus, it is possible to better suppress reduction in the force of water and disturbance in the flow that are caused by a pressure loss due to a flow of flush water curved at the top portion to return from the top portion toward the end portion of the intermediate part separating from the surface of the intermediate part, on the inner side portion side, at the time of the flush water flowing to the inner side portion side from the end portion of the intermediate part. Also, the flush water is enabled to easily flow along the surface of the intermediate part, on the inner side portion side, and reduction in the force of flow of water discharged from the rim spout port portion into the bowl may be better suppressed, and moreover, water may be discharged with a better adjusted flow. Accordingly, flushing performance for the bowl may be even more increased in the case where flush water is discharged rearward into the bowl from the rim spout portion after passing through the rim water passage that faces forward and is then curved to face rearward.

In an embodiment of the disclosure, preferably, the outer side portion of the rim water passage is formed to extend more forward than the intermediate part, and is formed to extend more forward than the inner side portion. According to an embodiment of the disclosure having a configuration as described above, the outer side portion of the rim water passage is formed to extend more forward than the intermediate part, and is formed to extend more forward than the inner side portion. Thus, compared to a case where the outer side portion is not formed to extend more forward than the intermediate part, a flow channel cross-sectional area at the curved portion may be made relatively large, and a change in the flow channel cross-sectional area from the outer side portion to the inner side portion, via the curved portion, may be suppressed. Accordingly, it is possible to better suppress reduction in the force of water and disturbance in the flow that are caused by a pressure loss occurring when the flow from the outer side portion reaches the inner side portion via the curved portion, and also, reduction in the force of flow of water discharged from the rim spout port portion into the bowl may be better suppressed, and moreover, water may be discharged with a better adjusted flow.

In an embodiment of the disclosure, preferably, the outer side portion of the rim water passage includes a curved-portion-side linear portion that is connected to the curved portion, and the inner side portion of the rim water passage includes a spout-port-side linear portion that is connected to the rim spout port portion. According to an embodiment of the disclosure having a configuration as described above, the outer side portion of the rim water passage includes the curved-portion-side linear portion that is connected to the curved portion, and the inner side portion of the rim water passage includes the spout-port-side linear portion that is connected to the rim spout port portion. Accordingly, compared to a case where the outer side portion and the inner side portion are formed as curved portions, it is possible to better suppress reduction in the force of water and disturbance in the flow that are caused by a pressure loss occurring when the flow passes through the outer side portion and the inner side portion, and also, reduction in the force of flow of water discharged from the rim spout port portion into the bowl may be better suppressed, and moreover, water may be discharged with a better adjusted flow.

In an embodiment of the disclosure, preferably, a horizontal width of the inner side portion in the top view is greater than a horizontal width of the outer side portion in the top view. According to an embodiment of the disclosure having a configuration as described above, because the horizontal width of the inner side portion in the top view is greater than the horizontal width of the outer side portion in the top view, when the flush water flows from the outer side portion into the inner side portion via the curved portion, the flush water is able to smoothly flow into the inner side portion with a greater horizontal width than the outer side portion. Thus, it is possible to better suppress reduction in the force of water and disturbance in the flow that are caused by a pressure loss, and also, reduction in the force of flow of water discharged from the rim spout port portion into the bowl may be better suppressed, and moreover, water may be discharged with a better adjusted flow.

With the flush toilet of an embodiment of the disclosure, reduction in the force of water and disturbance in the flow caused by a pressure loss caused by a flow curved separating from the surface on the inner side portion side of the intermediate part may be suppressed.

DETAILED DESCRIPTION

Next, a flush toilet according to an embodiment of the present disclosure will be described with reference to FIGS. 1 to 3.

Figure 1:
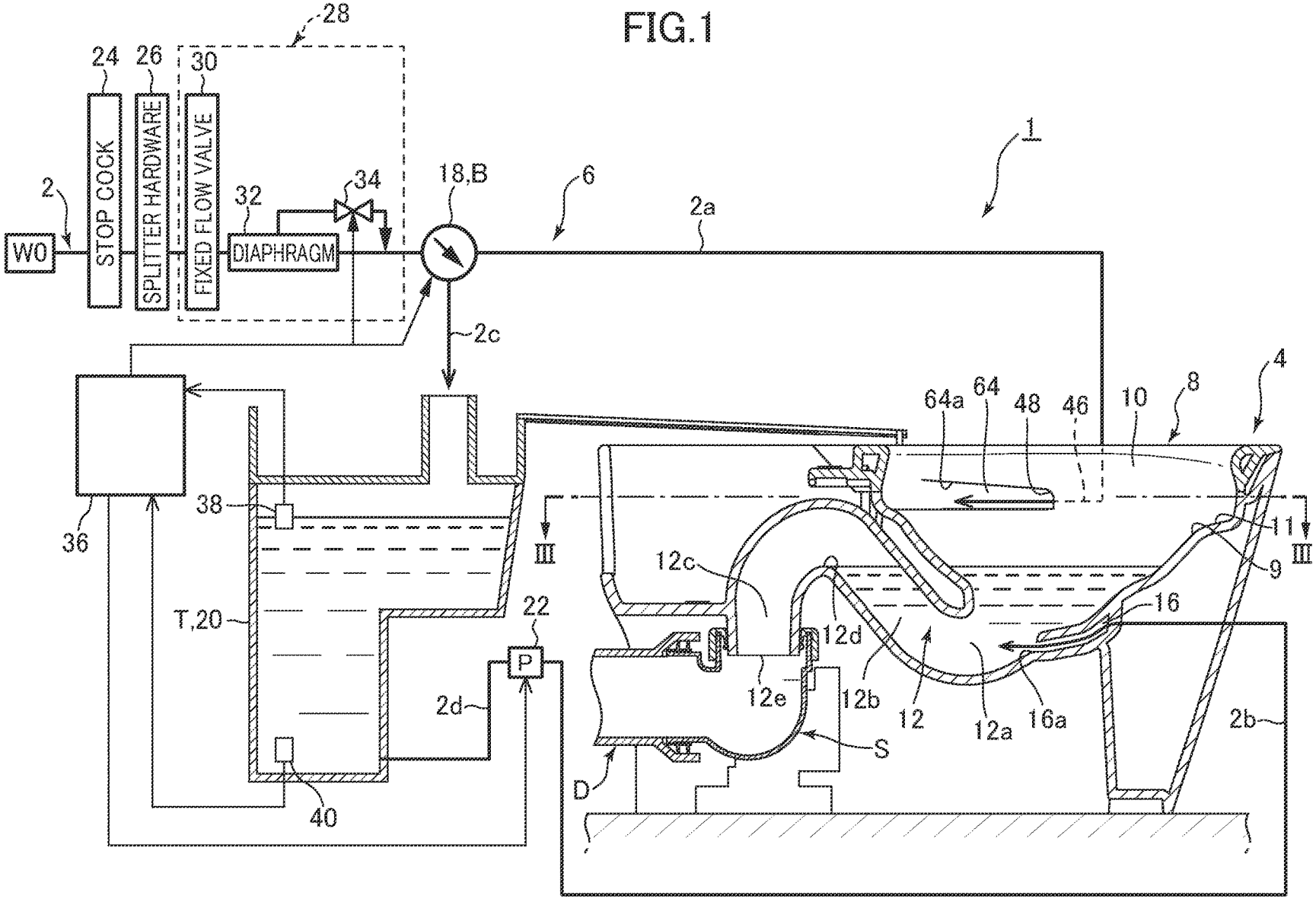
FIG. 1 is an overall structural diagram of a flush toilet according to an embodiment of the present disclosure.

FIG. 1 is an overall structural diagram of the flush toilet according to the embodiment of the present disclosure. Furthermore, FIG. 2 is a plan view of the flush toilet according to the embodiment of the present disclosure, and FIG. 3 is a cross-sectional view taken along a line in FIG. 1.

As shown in FIG. 1, a flush toilet 1 according to an embodiment of the present disclosure includes a main water passageway 2 where flush water that is supplied from a main water supply source W0 (a flush water supply source) such as a water system flows through, a toilet main body 4 made of ceramics, and a flush water supply device 6. The flush toilet 1 discharges waste with flush water supplied from the main water supply source W0. In the following description about the embodiment of the present disclosure, a description is given taking a side closer to a user using the flush toilet 1 (a user who is standing in front of the flush toilet 1 to use the flush toilet 1) as a front side, a back side as seen from the user as a rear side, a right side of the flush toilet 1 as seen from the front side as a right side, and a left side as seen from the front side as a left side.

Figure 2:
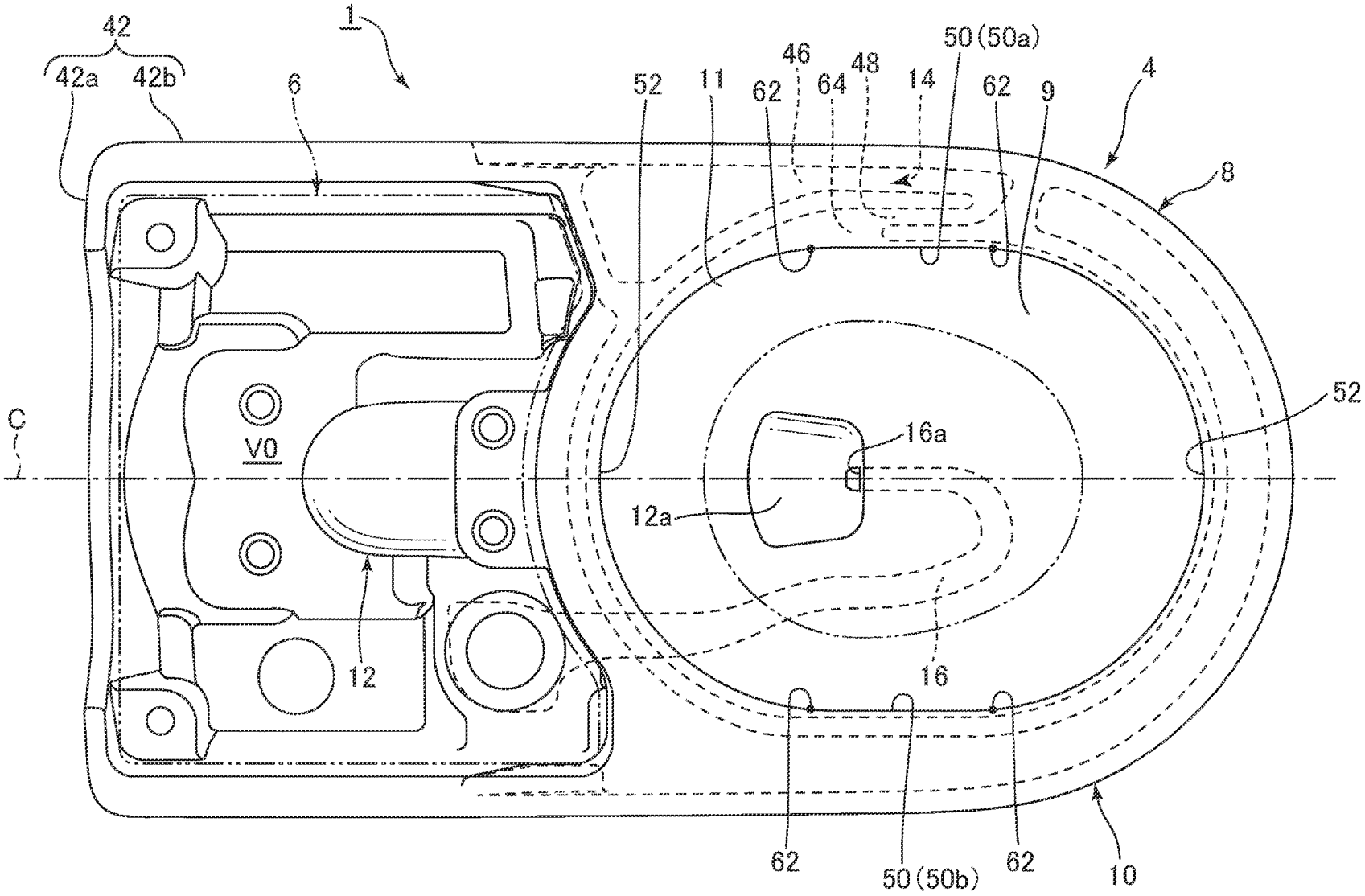
FIG. 2 is a plan view of the flush toilet according to the embodiment of the present disclosure.

Next, as shown in FIGS. 1 and 2, the toilet main body 4 includes a bowl 8 for receiving waste, a rim portion 10 that is formed in a top edge of the bowl 8, and a water discharge trap pipe 12 that is a water discharge trap section extending from a bottom portion of the bowl 8. Furthermore, although details will be given later, the flush water supply device 6 is a functional unit that is provided more rearward than the bowl 8 of the toilet main body 4 and that enables flush water supplied from the main water passageway 2 to be supplied to the toilet main body 4. More specifically, the functional unit includes a function of controlling discharge and stopping of flush water to the bowl 8 of the toilet main body 4 by operating on electric power.

The bowl 8 includes a bowl-shaped waste receiving surface 9, the rim portion 10 formed in a top edge of the waste receiving surface 9, and a shelf surface 11 that is provided along an entire circumference to connect the waste receiving surface 9 and the rim portion 10. The shelf surface 11 is formed as a flat surface between the waste receiving surface 9 and the rim portion 10, and is formed as an inward and slightly downward slope. The shelf surface 11 extends alongside with and approximately in parallel with the rim portion 10, on an inner side of the rim portion 10. Accordingly, the shelf surface 11 forms linear parts on inner sides of a right linear portion 50*a* and a left linear portion 50*b* described later, and forms arc portions on inner sides of front and rear arc portions 52 described later.

Figure 3:
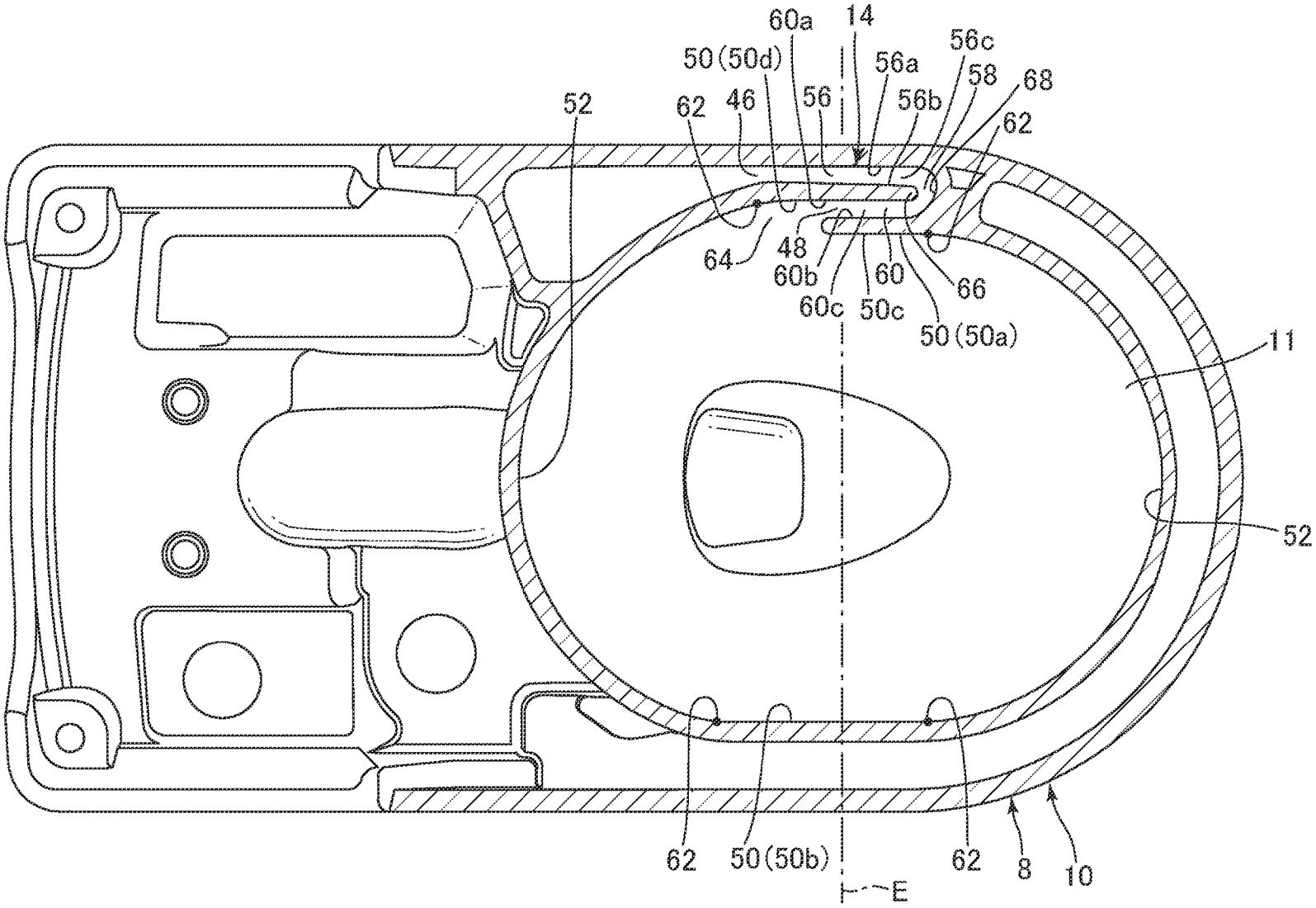
FIG. 3 is a cross-sectional view taken along a line in FIG. 1.

Next, as shown in FIGS. 2 and 3, the rim portion 10 of the bowl 8 includes a rim spout portion 14 for forming a circulating flow inside the bowl 8 by discharging flush water supplied from the flush water supply source into the bowl 8. The rim spout portion 14 is provided in the rim portion 10, on one of left and right sides of the bowl 8 of the toilet main body 4 (for example, on the right side when the toilet main body 4 is seen from the front side). Furthermore, the rim spout portion 14 forms a rim water passage 46 where supplied flush water flows through, and also forms a rim spout port portion 48 for discharging the flush water rearward, the rim spout port portion 48 being formed on a downstream end of the rim water passage 46. The rim water passage 46 forms a rim conduit inside the rim portion 10. The rim water passage 46 has a so-called U-turn shape that extends forward from the rear side of the toilet main body 4 and then bends rearward, the rim water passage 46 extending inside the rim portion 10, on one of the left and right sides of the toilet main body 4 (for example, on the right side of the toilet main body 4 seen from the front side). Furthermore, a rim-side water supply channel 2*a* of the flush water supply device 6, of which more later, is connected on an upstream side of the rim water passage 46. Flush water that is supplied from the rim-side water supply channel 2*a* to the rim water passage 46 is discharged into the bowl 8, rearward from the rim spout port portion 48, and rim spouting is thus performed.

Next, as shown in FIGS. 1 and 2, a jet conduit 16 is formed extending from an outer surface of the bowl 8 of the toilet main body 4 to the bottom portion. A downstream side of the jet conduit 16 faces an inlet 12*a* of the water discharge trap pipe 12 at the bottom portion of the bowl 8, and a jet spout port 16*a* is provided on a downstream end of the jet conduit 16.

Furthermore, a jet-side water supply channel 2*b* of the flush water supply device 6, of which more later, is provided on an upstream side of the jet conduit 16 of the toilet main body 4. Flush water that is supplied from the jet-side water supply channel 2*b* to the jet conduit 16 of the toilet main body 4 is discharged from the jet spout port 16*a* toward the water discharge trap pipe 12, and jet spouting is thus performed.

Now, as shown in FIG. 1, an upstream side of the rim-side water supply channel 2*a* of the flush water supply device 6 is connected to a switching valve 18 (of which more later) at a branch part B on the main water passageway 2. On the other hand, an upstream side of the jet-side water supply channel 2*b* of the flush water supply device 6 is connected to a pressure pump 22 (of which more later) of the flush water supply device 6 provided on a downstream side of a storage tank 20 of the flush water supply device 6, as shown in FIG. 1.

Next, the water discharge trap pipe 12 of the toilet main body 4 forms a discharge conduit that is connected at a lower part of the bowl 8 and that is for discharging waste. The water discharge trap pipe 12 includes the inlet 12*a* provided at the bottom portion of the bowl 8, a trap ascending pipe 12*b* that ascends from the inlet 12*a*, and a trap descending pipe 12*c* that descends from the trap ascending pipe 12*b*, and a part between the trap ascending pipe 12*b* and the trap descending pipe 12*c* is made a top portion 12*d*. Furthermore, as shown in FIG. 1, an outlet 12*e* of the trap descending pipe 12*c* of the water discharge trap pipe 12 is connected to an inlet of a discharge socket S that is disposed behind and below the toilet main body 4. Furthermore, as shown in FIG. 1, an outlet of the discharge socket S on the rear side is connected to an inlet of a drain pipe D extending from a wall (not shown) on the rear side of the toilet main body 4. Water is accumulated above a coupling portion between the waste receiving surface 9 and the water discharge trap pipe 12. Additionally, in the present example, a construction where water is discharged from the water discharge trap pipe 12 to the drain pipe D in the wall behind the flush toilet 1 is described, but construction is not limited to construction in which water is drained through the wall, and a discharge socket for discharging water through a floor may be connected to the discharge water and may discharges water to a drain pipe provided in the floor.

Next, each structure of the flush water supply device 6 of the flush toilet 1 according to the present embodiment will be schematically described with reference to FIG. 1.

First, as shown in FIG. 1, the flush water supply device 6 includes, from an upstream side to a downstream side of the main water passageway 2, a stop cock 24, splitter hardware 26, a valve unit 28, and the switching valve 18.

Next, the valve unit 28 includes a fixed flow valve 30, a diaphragm main valve 32, and an electromagnetic valve 34 such as a solenoid valve.

Furthermore, the flush water supply device 6 includes a controller 36. The controller 36 includes an arithmetic device such as a CPU and a storage device such as a memory embedded therein, and is capable of controlling electrically connected units according to predetermined control programs and the like. In the present embodiment, the controller 36 is capable of functioning as a controller that controls an opening-closing operation of an on-off valve (the electromagnetic valve 34) of the valve unit 28, a switching operation of the switching valve 18, and a rotational speed, an operation time and the like of the pressure pump 22.

Moreover, the fixed flow valve 30 of the valve unit 28 is for reducing flush water flowing from the stop cock 24 on the main water passageway 2 and through the splitter hardware 26 to or below a predetermined flow rate.

Additionally, in a mode where the flush toilet 1 is provided with a private part washing device (not shown), a water supply pipe (not shown) for supplying flush water to the private part washing device (not shown) may also be connected to the splitter hardware 26.

Furthermore, at the valve unit 28, when an opening operation is performed on the electromagnetic valve 34 by the controller 36, the main valve 32 is opened, and flush water passing from the fixed flow valve 30 and through the main valve 32 is supplied to the switching valve 18 at the branch part B on the downstream side of the main water passageway 2.

The switching valve 18 is capable of supplying flush water from the main water passageway 2 to the rim-side water supply channel 2*a* and a tank-side water supply channel 2*c* at a same timing, and a ratio between water supplied to the rim side and water supplied to the tank side may be freely changed.

Next, the flush water supply device 6 includes a tank device T that enables flush water supplied from the main water passageway 2 to be supplied to the toilet main body 4. The tank device T includes the storage tank 20 that is coupled to a rear side of the toilet main body 4 and that is for storing flush water supplied from the main water passageway 2, and the pressure pump 22 for feeding the flush water in the storage tank 20 to the toilet main body 4 under pressure.

Furthermore, the rim-side water supply channel 2*a* that communicates with the rim water passage 46 of the toilet main body 4, and the tank-side water supply channel 2*c* that is connected to the storage tank 20 are provided on the downstream side of the branch part B on the downstream side of the main water passageway 2.

Accordingly, flush water that is supplied from the main water supply source W0 to the branch part B of the main water passageway 2 is used as water to be supplied to at least one of the rim-side water supply channel 2*a* to be supplied to the rim and the tank-side water supply channel 2*c* to be supplied to the tank.

Furthermore, the flush water supply device 6 includes a pump water supply channel 2*d* that extends from a downstream side of the tank-side water supply channel 2*c* to the pressure pump 22, and the jet-side water supply channel 2*b* that extends on a downstream side from the pressure pump 22.

Accordingly, with the flush toilet 1 of the present embodiment, flush water that is supplied from the main water passageway 2 and that is directly supplied under tap water pressure may be supplied from the rim-side water supply channel 2*a* of the flush water supply device 6 to the rim spout port portion 48, via the rim water passage 46 of the toilet main body 4, and water may thus be discharged from the rim spout port portion 48 (so-called "rim spouting").

Furthermore, the flush water supplied from the main water passageway 2 to the flush water supply device 6 may flow through the tank-side water supply channel 2*c*, the storage tank 20, the pump water supply channel 2*d* and the pressure pump 22 of the flush water supply device 6 and then be supplied from the jet-side water supply channel 2*b* to the jet spout port 16*a*, via the jet conduit 16 of the toilet main body 4, and water may thus be discharged water from the jet spout port 16*a* (so-called "jet spouting"). That is, the flush toilet 1 of the present embodiment may function as a so-called hybrid flush toilet 1 that is capable of using, in combination, rim spouting that uses flush water that is supplied from the main water passageway 2 and that is directly supplied under tap water pressure, and jet spouting that uses flush water that is from the storage tank 20 and that is pressurized by the pressure pump 22.

Now, an upper float switch 38 and a lower float switch 40 are disposed inside the storage tank 20. A water level inside the storage tank 20 may be detected by these float switches 38, 40.

For example, the upper float switch 38 is switched on when the water level inside the storage tank 20 reaches a predetermined water storage level, and the controller 36 detects an on state of the upper float switch 38 and causes the electromagnetic valve 34 to close.

On the other hand, the lower float switch 40 is switched on when the water level inside the storage tank 20 falls to a predetermined water level below the predetermined water storage level that is detected by the upper float switch 38, and the controller 36 detects an on state of the lower float switch 40 and causes the pressure pump 22 to stop.

Furthermore, the pressure pump 22 sucks the flush water stored in the storage tank 20 into the pump water supply channel 2*d* and pressurizing the flush water from the pump water supply channel 2*d* into the jet-side water supply channel 2*b* and discharges the flush water from the jet spout port 16*a*.

With the structures described above, at a time of normal toilet flushing, the controller 36 detects operation of a toilet flushing switch (not shown) by a user, for example, and causes the electromagnetic valve 34, the switching valve 18, and the pressure pump 22 to sequentially operate. Discharge of water from the rim spout port portion 48 and the jet spout port 16*a* is thus sequentially started, and flush water used to flush the bowl 8 is drained from the water discharge trap pipe 12, together with waste in the bowl 8. Furthermore, the controller 36 opens the electromagnetic valve 34 after flushing is finished and the switching valve 18 is switched to the tank-side water supply channel 2*c* side, and flush water in the main water passageway 2 is used to refill the storage tank 20.

Then, when the water level inside the storage tank 20 rises and the upper float switch 38 detects a specified water storage amount, the controller 36 closes the electromagnetic valve 34 so that the main valve 32 closes the main water passageway 2, and supply of water is thereby stopped. Moreover, each of the above-described units of the flush water supply device 6 (functional unit) is provided in a rear function housing unit V0 (see FIG. 2) in a region behind the bowl 8 of the toilet main body 4.

Next, a structure of the bowl 8 of the toilet main body 4 of the flush toilet 1 according to the present embodiment is explained with reference to FIGS. 1 to 3.

The rim portion 10 of the bowl 8 includes linear portions 50 that are disposed alongside each other on right and left sides of the bowl 8 in a top view while extending in approximately same directions, and arc portions 52 that connect the right and left linear portions 50 of the bowl 8 at front end portions and rear end portions of the linear portions 50.

The linear portions 50 of the rim portion 10 include the right linear portion 50*a* and the left linear portion 50*b*, the right linear portion 50*a* and the left linear portion 50*b* extending linearly in a front-back direction on the right side and the left side, respectively, of the bowl 8 in the top view. The right linear portion 50*a* and the left linear portion 50*b* are each disposed between a connecting portion 62 between the arc portion 52 on the front side and the linear portion 50 and a connecting portion 62 between the arc portion 52 on the rear side and the linear portion 50. The connecting portion 62 forms a curvature change portion that connects the arc portion 52 that has an arc shape and the linear portion 50 that has a linear shape. Additionally, the linear portions 50 extend substantially in parallel to each other on the right and left sides of the bowl 8. The linear portions 50 do not have to be formed alongside each other on the right and left sides of the bowl 8 while having a same length. Because the linear portions 50 of the rim portion 10 are formed to have a linear shape, splashing of water and energy loss caused by flush water on the shelf surface 11 hitting the linear portions 50 and the like of the rim portion 10 may be suppressed, and flush water may be discharged in such a way that a relatively strong flow of flush water may be formed in the bowl 8. The linear portions 50 desirably have a linear shape, but an approximately linear shape that is curved so as not to cause flush water to hit the linear portions 50 and the like of the rim portion 10 and to splash is also acceptable.

Furthermore, the linear portions 50 of the rim portion 10 include, in a horizontal cross-section at a height around a center of the rim spout portion 14 as shown in FIG. 3, a front right linear portion 50*c* that extends in the front-back direction at a position more forward than the rim spout port portion 48 and on an inner side in the toilet main body, and a rear right linear portion 50*d* that extends in the front-back direction at a position more rearward than the rim spout port portion 48 and on an outer side in the toilet main body. The rim spout port portion 48 is provided in a rear region of the toilet main body 4 on a rear side than a center (a central transversal line E extending in a left-right direction to equally divide the bowl 8 in the front-back direction) of the toilet main body 4.

The front right linear portion 50*c* and the rear right linear portion 50*d* are disposed alongside each other. The front right linear portion 50*c* and the rear right linear portion 50*d* extend substantially in parallel to each other. Because the rim spout port portion 48 that faces rearward is formed at the right linear portion 50*a*, the front right linear portion 50*c* and the rear right linear portion 50*d* are formed so as to be shifted from each other in a stepwise manner between inner and outer sides. The front right linear portion 50*c* and the rear right linear portion 50*d* are disposed shifted from each other in the front-back direction, and the front right linear portion 50*c* and the rear right linear portion 50*d* do not have to be formed alongside each other with a same length. The front right linear portion 50*c* and the rear right linear portion 50*d* form the right linear portion 50*a* that extend approximately in the front-back direction. The front right linear portion 50*c* and the rear right linear portion 50*d* extend substantially in parallel to and alongside the left linear portion 50*b*. Furthermore, the front right linear portion 50*c* and the rear right linear portion 50*d* also extend substantially in parallel to a center cross-section C along the front-back direction of the toilet main body 4. Moreover, the front right linear portion 50*c* and the rear right linear portion 50*d* extend substantially in parallel to and alongside each of an outer side portion 56 and an inner side portion 60 of the rim water passage 46 described later.

The arc portion 52 is defined as a single arc that is defined by approximately one curvature radius. The arc portion 52 is formed so as to protrude forward between the connecting portion 62 on the front side of the right linear portion 50*a* and the connecting portion 62 on the front side of the left linear portion 50*b*. Furthermore, the arc portion 52 is formed so as to protrude rearward between the connecting portion 62 on the rear side of the right linear portion 50*a* and the connecting portion 62 on the rear side of the left linear portion 50*b*. The arc portion 52 may be defined basically as a single arc that is defined by one curvature radius, but with each of both end portions being defined as a different arc defined by a different curvature radius. In this manner, the arc portion 52 may be formed as a complex arc, with a part thereof being defined as a different arc that is defined by a different curvature radius. Furthermore, the whole arc portion 52 may be defined by a plurality of arcs that are defined by a plurality of curvature radii. Furthermore, with respect to the arc portions 52, only the arc portion on the front side may be defined as a predetermined arc as described above. Additionally, a length in the front-back direction from the connecting portion 62, between the linear portion 50 and the arc portion 52, to a front end (or a rear end) of the arc portion 52 (a radius of the arc portion 52) is greater than a length of the linear portion 50 in the front-back direction. When the radius of the arc portion 52 is greater than the length of the linear portion 50, a flow of flush water flowing from the linear portion 50 to the arc portion 52 changes slowly, and splashing of flush water flowing from the linear portion 50 to the arc portion 52 may be suppressed. Moreover, the radius of the arc portion 52 on the rear side (the length in the front-back direction from the connecting portion 62, between the linear portion 50 and the arc portion 52 on the rear side, to the rear end of the arc portion 52 on the rear side) is greater than the radius of the arc portion 52 on the front side (the length in the front-back direction from the connecting portion 62, between the linear portion 50 and the arc portion 52 on the front side, to the front end of the arc portion 52 on the front side), and thus, because a bowl surface is wider on the rear side, user can feel more relaxed at the time of excretion, both when user is excreting at a standing position and at a sitting position.

The rim water passage 46 includes the outer side portion 56 that extends inside the rim portion 10, toward the front side, a curved portion 58 that is curved inward from a downstream end of the outer side portion 56, and the inner side portion 60 that extends rearward from the curved portion 58 to the rim spout port portion 48.

Figure 5:
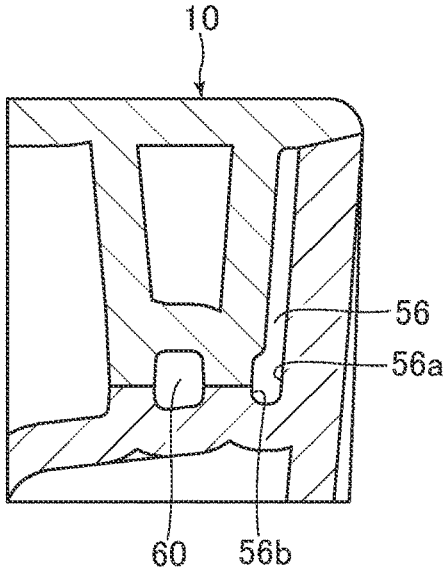
FIG. 5 is a cross-sectional view taken along a line V-V in FIG. 4.

The outer side portion 56 extends from the rear region of the toilet main body 4 to a front region more forward than the center (the central transversal line E extending in the left-right direction to equally divide the bowl 8 in the front-back direction) of the toilet main body 4. The outer side portion 56 forms a flow channel that is positioned on an outer side than the inner side portion 60. As shown in FIG. 5, an outer-side-portion outer side wall 56*a* and an outer-side-portion inner side wall 56*b* of the outer side portion 56 extend substantially in parallel to and alongside each other, and a gap between the two side walls are assumed to be substantially constant. A ceiling surface and a bottom surface of the outer side portion 56 are formed substantially in parallel to and alongside each other, and a flow channel cross-sectional area inside the outer side portion 56 is maintained approximately constant at the outer side portion 56. The outer side portion 56 forms a flow channel that extends linearly in the front-back direction. The outer side portion 56 includes a curved-portion-side linear portion 56*c* that is connected to the curved portion 58. The curved-portion-side linear portion 56*c* forms a flow channel that extends linearly at least up to the curved portion 58. The curved-portion-side linear portion 56*c* may adjust the flow of flush water just before reaching the curved portion 58 to be linear.

The curved portion 58 forms a U-shaped flow channel in the top view to connect the outer side portion 56 extending from the rear side and the inner side portion 60 extending toward the rear side. Accordingly, the curved portion 58 is formed to cause flush water flowing in from the rear side to flow out toward the rear side. The curved portion 58 is formed at a position more rearward than the connecting portion 62 between the linear portion 50 and the arc portion 52 on the front side of the linear portion 50. Accordingly, the curved portion 58 is formed into a U-turn shape inside the rim portion 10 that extends linearly. This suppress the U-turn shape of the curved portion 58 from being deformed inside the rim portion 10 that is curved, and an increase in a pressure loss may be suppressed. The curved portion 58 is positioned in the front region more forward than the central transversal line E of the toilet main body 4.

Figure 4:
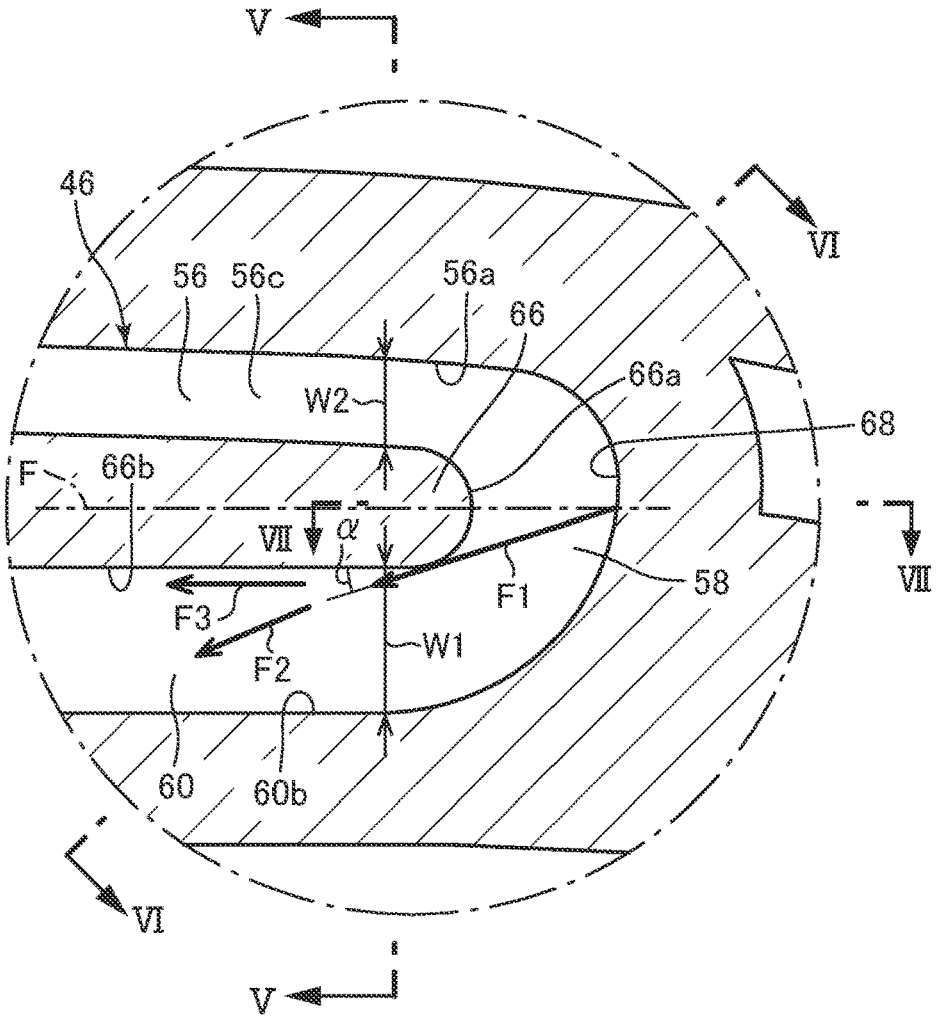
FIG. 4 is partial enlarged cross-sectional view showing a curved portion of a rim conduit in FIG. 3 and its surroundings.

As shown in FIG. 4, the curved portion 58 includes a top portion 68 at a position farthest from an intermediate part 66, provided between the inner side portion 60 and the outer side portion 56 in the top view, in a direction extending the intermediate part 66. The top portion 68 forms a top portion that is a part that protrudes the most in the direction extending the intermediate part 66. The top portion 68 is formed in more the outer side portion 56 side than a virtual center line F that extends along a center of the intermediate part 66. The top portion 68 is formed on an outer side than the intermediate part 66. The top portion 68 is formed into an arc shape (arc-like shape) in the top view. The top portion 68 is formed on a wall surface that faces the intermediate part 66 in the top view. An end portion 66*a* of the intermediate part 66, on the curved portion 58 side, is also formed into an arc shape in the top view. A curvature radius of the end portion 66*a* of the intermediate part 66, on the curved portion 58 side, is smaller than a curvature radius of the top portion 68. Accordingly, in a flow of flush water curved in the top portion 68, a flow to return from the top portion 68 toward the end portion 66*a* of the intermediate part 66, as indicated by an arrow F1, is separated from a surface 66*b* on the inner side portion 60 side of the intermediate part 66, as indicated by an arrow F2, and therefore it is possible to further suppress reduction in the force of water and disturbance in the flow that are caused by a pressure loss, and therefore, a flow of flush water curved in the top portion 68 may flow along the surface 66*b* on the inner side portion side of the intermediate part 66, as indicated by an arrow F3.

Figure 6:
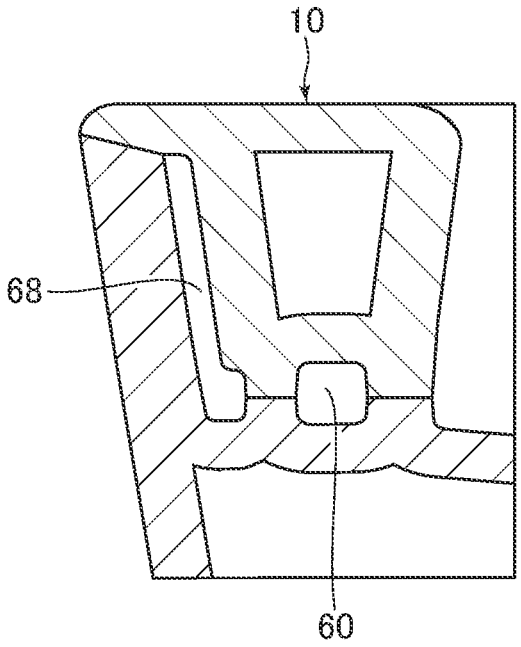
FIG. 6 is a cross-sectional view taken along a line VI-VI in FIG. 4.
Figure 7:
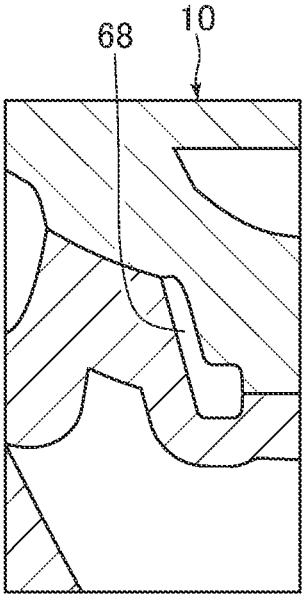
FIG. 7 is a cross-sectional view taken along a line VII-VII in FIG. 4.

The outer side portion 56 of the rim water passage 46 is formed to extend more forward than the intermediate part 66, and the outer side portion 56 is also formed to extend more forward than the inner side portion 60. The outer-side-portion outer side wall 56*a* of the outer side portion 56 forms a linear wall surface that extends more forward than the end portion 66*a* of the intermediate part 66 to form the outer side portion 56. On the other hand, an inner-side-portion inner side wall 60*b* of the inner side portion 60 forms a linear wall surface that extends to around the end portion 66*a* of the intermediate part 66. In this manner, the curved portion 58 is formed with the outer side portion 56 extending more forward than the intermediate part 66, and thus, an angle that is formed between a flow that returns from the top portion 68 toward the end portion 66*a* of the intermediate part 66 and the surface 66*b* of the intermediate part 66, on the inner side portion side, becomes a relatively small acute angle, and the flow is less likely to be separated from the surface 66*b* on the inner side portion side of the intermediate part 66. Furthermore, compared to a case where the outer side portion 56 is not formed in a manner extending more forward than the intermediate part 66, because the outer side portion 56 is curved after extending more forward than the intermediate part 66, the flow channel cross-sectional area at the curved portion 58 may be made relatively large. Accordingly, a change in the flow channel cross-sectional area from the outer side portion 56 to the curved portion 58 may be made small at a position where a width of the flow channel is increased from the outer side portion 56 toward the inner side portion 60 and where the flow channel cross-sectional area is increased, and also, a change in the flow channel cross-sectional area in the curved portion 58, from the curved portion 58 toward the inner side portion 60, may be suppressed. Accordingly, a change in the flow channel cross-sectional area may be suppressed along the outer side portion 56, the curved portion 58 and the inner side portion 60. For example, a change between the flow channel cross-sectional area in the outer side portion 56 as shown in FIG. 5 and the flow channel cross-sectional area in the curved portion 58 as shown in FIG. 6 is relatively small, and also, a change between the flow channel cross-sectional area in the curved portion 58 as shown in FIG. 6 and the flow channel cross-sectional area in the curved portion 58 as shown in FIG. 7 is relatively small. In this manner, a change in the flow channel cross-sectional area from the outer side portion 56 to the curved portion 58 is made relatively small.

The inner side portion 60 extends from the front region of the toilet main body 4 to the rear region of the toilet main body 4 behind the central transversal line E. The inner side portion 60 extends to around a center of the toilet main body 4. An inner-side-portion outer side wall 60*a* and the inner-side-portion inner side wall 60*b* of the inner side portion 60 extend substantially in parallel to and alongside each other, and a gap between the two side walls is approximately constant. A ceiling surface and a bottom surface of the inner side portion 60 are formed substantially in parallel to and alongside each other, and the flow channel cross-sectional area inside the inner side portion 60 is maintained approximately constant in the inner side portion 60. A horizontal width W1 of the inner side portion 60 in the top view is greater than a horizontal width W2 of the outer side portion 56 in the top view. The inner side portion 60 forms a flow channel that extends linearly in the front-back direction. The inner side portion 60 includes a spout-port-side linear portion 60*c* that is connected to the rim spout port portion 48. The spout-port-side linear portion 60*c* forms a flow channel that extends linearly at least up to the rim spout port portion 48. The spout-port-side linear portion 60*c* may adjust the flow of flush water just before reaching the rim spout port portion 48 to be linear. For example, the inner side portion 60 is formed to have a length within a range of 40 mm to 60 mm. Additionally, the inner side portion 60 may extend and terminate in the front region more forward than the central transversal line E.

Just one rim spout port portion 48 is formed in an inner circumferential surface of the rim portion 10, as a single rim spout portion, and the rim spout port portion 48 is formed to discharge water to the rear side of the bowl through the linear portion 50, along a direction extending the linear portion 50. The rim spout port portion 48 forms an opening at a rear end portion of the inner side portion 60. An opening direction of the rim spout port portion 48 is approximately the same as a direction extending the flow channel in the spout-port-side linear portion 60*c* of the inner side portion 60. The rear right linear portion 50*d* is positioned on a rear side of the inner-side-portion outer side wall 60*a* of the inner side portion 60, on a same straight line, and is connected to the inner-side-portion outer side wall 60*a* while being on the substantial same plane with the inner-side-portion outer side wall 60*a*. Accordingly, when flush water flows out from the rim spout port portion 48, the flush water may linearly flow out along the inner-side-portion outer side wall 60*a* and the rear right linear portion 50*d*. The rear right linear portion 50*d* extends substantially in parallel to and alongside the inner-side-portion inner side wall 60*b* of the inner side portion 60. Accordingly, flush water that is linearly discharged may be suppressed from being disturbed. For example, the rear right linear portion 50*d* is formed to have a length within a range of 100 mm to 120 mm.

The bowl 8 further includes a rim-spout-section water passageway 64 that extends on the rear side of the rim spout port portion 48, the rim-spout-section water passageway 64 extending from the rim spout port portion 48 in the direction extending the linear portion 50 such as the rear right linear portion 50*d*, for example. As shown in FIG. 1, a ceiling surface 64*a* of the rim-spout-section water passageway 64 is formed in a manner overhanging from an inner side of the bowl 8 to an outer side, and the rim-spout-section water passageway 64 is formed as a C-shaped cut-out passage that is formed by cutting out the bowl 8 in a C-shape from an opening portion on the inner side toward a wall surface on the outer side. The rim-spout-section water passageway 64 on a downstream side of the rim spout port portion 48 is formed in an overhanging manner, and thus causes flush water that is discharged to flow to the shelf surface 11 while suppressing splashing of the flush water. In other words, the rim-spout-section water passageway 64 is provided on the downstream side of the rim spout port portion 48 and at a same height as the shelf surface 11, the rim-spout-section water passageway 64 being surrounded by an overhanging portion.

The rear right linear portion 50*d* is formed to have a length shorter than a length, in the front-back direction, of the left linear portion 50*b* that is not provided with the rim spout port portion 48 (the length of the left linear portion 50*b* in the front-back direction, between the front and rear connecting portions 62), and the connecting portion 62 to the arc portion 52 is provided within the rim-spout-section water passageway 64 that is formed in an overhanging manner. In the top view, the connecting portion 62 between the rear right linear portion 50*d* and the arc portion 52 and the connecting portion 62 between the left linear portion 50*b* and the arc portion 52 are approximately left-right symmetric across the center cross-section C, but the connecting portion 62 between the rear right linear portion 50*d* and the arc portion 52 is disposed more rearward than the connecting portion 62 between the right linear portion 50*a* and the arc portion 52. Accordingly, because flush water that is just discharged from the rim spout portion 48 and that is intense hits the curvature change portion of the connecting portion 62 inside the overhanging rim-spout-section water passageway 64, splashing of water to outside the bowl 8 may be suppressed. Furthermore, the arc portion formed inside the rim-spout-section water passageway 64 has a curvature radius that is big compared to that of the arc portion 52 on the rear side, and the flush water is caused to circulate from the rear right linear portion 50*d* to the arc portion 52 on the rear side, via the arc portion inside the rim-spout-section water passageway 64, and thus, the flush water may be circulated while reducing energy loss and water splashing.

Figure 8:
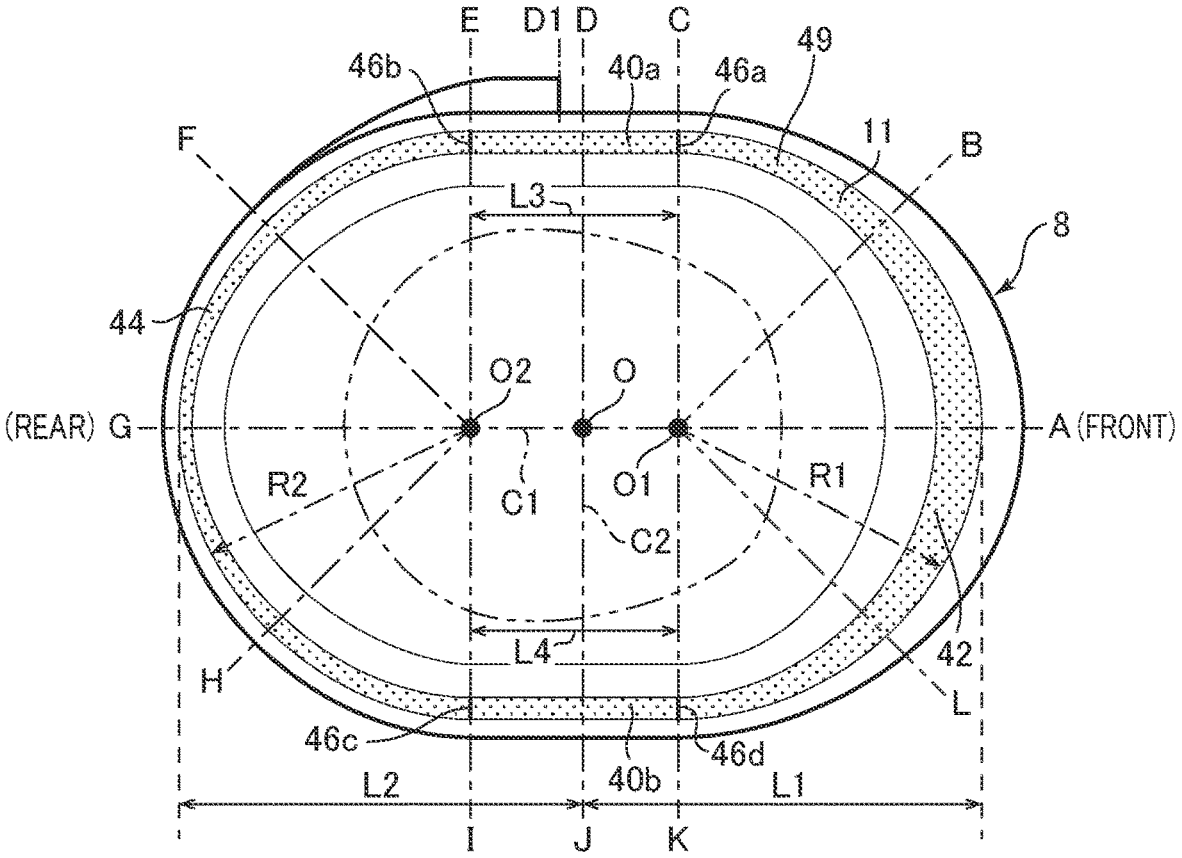
FIG. 8 is a plan view showing a bowl and a shelf of the flush toilet according to the embodiment of the present disclosure.
Figure 9:
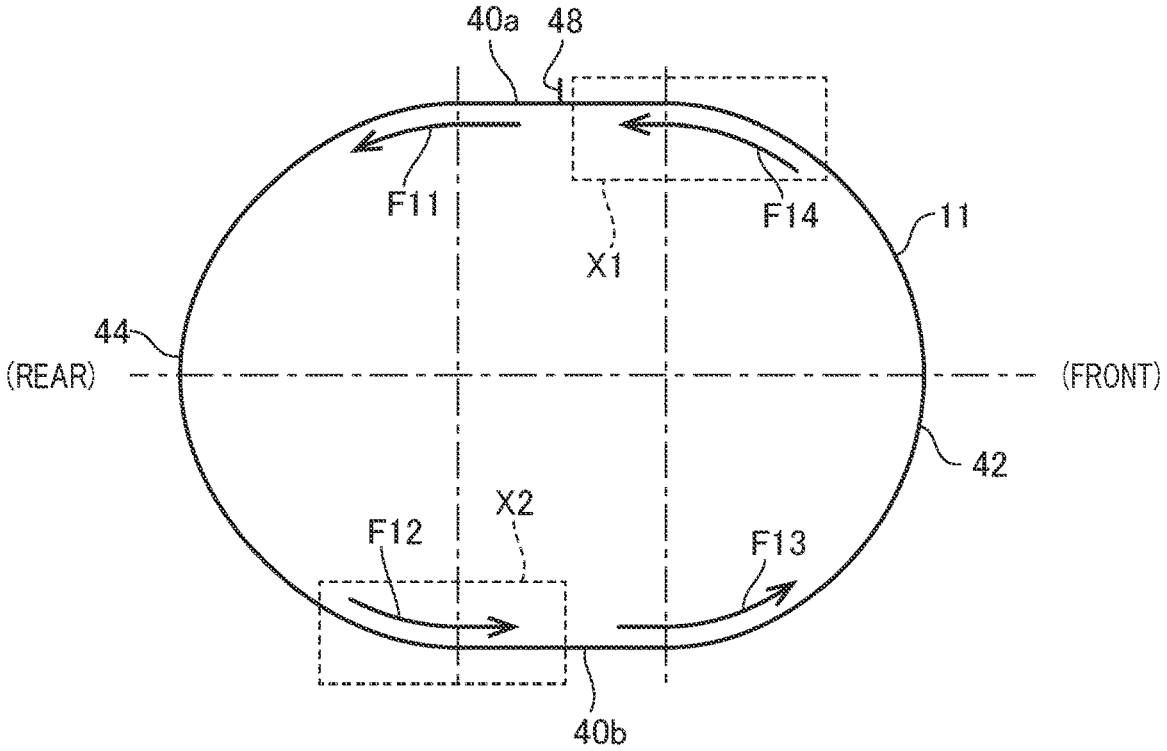
FIG. 9 is a schematic plan view of the shelf for describing a flow of flush water on the shelf of the flush toilet according to the embodiment of the present disclosure.

Next, a structure and the like of the shelf surface 11 of the bowl 8 will be described in detail with reference to FIGS. 8 and 9. FIG. 8 is a plan view showing the bowl and a shelf of the flush toilet according to the embodiment of the present disclosure, and FIG. 9 is a schematic plan view of the shelf for describing a flow of flush water on the shelf of the flush toilet according to the embodiment of the present disclosure.

First, as shown in FIG. 8, in the top view, the shelf surface 11 of the bowl 8 is formed by a right linear portion 40*a* and a left linear portion 40*b* that extend in parallel to each other on the right and left sides of the bowl 8, a front arc portion 42 connected to front ends of the right and left linear portions 40*a*, 40*b*, and a rear arc portion 44 connected to rear ends of the right linear portion 40*a* and the left linear portion 40*b*.

Specifically, the front end of the right linear portion 40*a* and the front arc portion 42 are connected by a connecting portion 46*a*, the rear end of the right linear portion 40*a* and the rear arc portion 44 are connected by a connecting portion 46*b*, the rear arc portion 44 and the rear end of the left linear portion 40*b* are connected by a connecting portion 46*c*, and the front end of the left linear portion 40*b* and the front arc portion 42 are connected by a connecting portion 46*d*.

The front arc portion 42 and the rear arc portion 44 are both formed to have a single curvature radius R1. Additionally, the front arc portion 42 and the rear arc portion 44 may each be formed by combining a plurality of curvature radii.

More specifically, as shown in FIG. 8, a front portion side and a rear portion side of the shelf surface 11 of the bowl 8 are each substantially left-right symmetric across a center line C1 (the center cross-section C) extending in the front-back direction, and are substantially front-back symmetric across a substantially center line C2 extending in a left-right width direction. Furthermore, the front arc portion 42 has a semicircular shape having a single radius R1 with a center O1, and similarly, the rear arc portion 44 has a semicircular shape having a single radius R2 with a center O2.

Moreover, in FIG. 8, a position A is a front end of the bowl 8, a position B is an intermediate position between the front end of the bowl 8 and the front end of the right linear portion 40*a*, a position C is the front end of the right linear portion 40*a*, a position D is an intermediate position of the right linear portion 40*a*, and a position D1 is a position of the rim spout port portion 48, and the position D and the position D1 are approximately at a same position. A position E is the rear end of the right linear portion 40*a*, a position F is an intermediate position between the rear end of the right linear portion 40*a* and a rear end of the bowl 8, a position G is the rear end of the bowl 8, a position H is an intermediate position between the rear end of the bowl 8 and the rear end of the left linear portion 40*b*, a position I is the rear end of the left linear portion 40*b*, a position J is an intermediate position of the left linear portion 40*b*, a position K is the front end of the left linear portion 40*b*, and a position L is an intermediate position between the front end of the left linear portion 40*b* and the front end of the bowl 8. Accordingly, a line connecting the position D and the position J is the substantially center line C2, and a line connecting the position A and the position G is the center line C1. Furthermore, a length between the substantially center line C2 and the position G in the front-back direction is greater than a length between the substantially center line C2 and the position A in the front-back direction. Accordingly, because the bowl surface is wider on the rear side, user can feel more relaxed at the time of excretion, both when user is excreting at a standing position and at a sitting position. A length between the position C and the position E in the front-back direction and a length between the position I and the position K in the front-back direction are substantially the same, and a length between the position E and the position G in the front-back direction is greater than the length between the position C(I) and the position E(K) in the front-back direction. Furthermore, a length between the position C and the position A in the front-back direction is greater than the length between the position C(I) and the position E(K) in the front-back direction. In other words, the radii R1, R2 of the front arc portion 42 and the rear arc portion 42 are greater than the length of the right (left) linear portion. In the case where the right (left) linear portion is longer than the radii R1, R2, the radii R1, R2 are relatively small and the flow of flush water from the linear portions to the arc portions is drastically changed, thus possibly causing the flush water to be scattered. By contrast, when the radii R1, R2 of the front arc portion 42 and the rear arc portion 42 are made greater than the length of the right (left) linear portion, a change of the flow of flush water from the linear portions to the arc portions is eased, and the flush water may be suppressed from being scattered.

Next, movement of flush water flowing on the shelf surface 11 of the bowl 8 will be described with reference to FIG. 9. As shown in FIG. 9, a flow of flush water flowing from the right linear portion 40*a* to the rear arc portion 44 is given as F11, a flow of flush water flowing from the rear arc portion 44 to the left linear portion 40*b* is given as F12, a flow of flush water flowing from the left linear portion 40*b* to the front arc portion 42 is given as F13, and a flow of flush water flowing from the front arc portion 42 to the right linear portion 40*a* is given as F14.

Flush water flowing along the right linear portion 40*a* and the left linear portion 40*b* of the shelf surface 11 does not easily flow down to the waste receiving surface 8 due to small flow channel resistance, but flush water flowing along the front arc portion 42 and the rear arc portion 44 easily flows down to the waste receiving surface 8 due to the flow being disturbed by the change in the direction of the flow. Influence of disturbance of the flow is greater than influence of centrifugal force.

Accordingly, with respect to the flows F12 and F14 of flush water flowing from the arc portions to the linear portions, the flush water does not easily flow down from the shelf surface 11, and with respect to the flows F11 and F13 of flush water flowing from the linear portions to the arc portions, the flush water easily flows down the shelf surface 11. Due to such movement of flush water, an unwashed part tends to occur on the waste receiving surface at a region X1 and a region X2 where the flush water flows from the arc portions to the linear portions.

In a rear region (including the region X2) of the bowl 8, the rim spout port portion 48 is positioned at the position D1 and water is discharged rearward from the rim spout port portion 48, and thus, because a distance from the rim spout port portion 48 is relatively small, force of the flush water is strong and the flush water is greatly disturbed, and the flush water easily flows down from the rear arc portion 44 and unwashed portions are not easily generated. However, in a front region (including the region X1) of the bowl 8, force of the flush water is weak and the flush water is not greatly disturbed, and the flush water does not easily flow down from the front arc portion 42 and unwashed portions are thereby easily generated. In the present embodiment, a sloping surface (an ascending surface) 49 that is raised toward the rim spout port portion 48 is formed in the region X1 in FIG. 9, or in other words, on the shelf surface 11 extending from the front arc portion 42 to the right linear portion 40*a*. Because the ascending surface 49 is formed on the shelf surface 11, a flow velocity of the flush water is reduced, and thus, unwashed portions may be suppressed from being generated on the waste receiving surface 8 lower than the shelf surface 11 in the region of the rim spout port portion 48 (or the intermediate position D of the right linear portion 40*a*).

Next, movement (action) of the flush water in the rim water passage 46 according to the embodiment of the present disclosure will be described with reference to FIGS. 3 and 4.

Flush water that is supplied from the rim-side water supply channel 2*a* to the rim water passage 46 flows inside the outer side portion 56 of the rim water passage 46 toward the front side. Because the outer side portion 56 extends linearly toward the front side, the flush water flows linearly with the flow adjusted along the outer side portion 56. The flush water flowing from the outer side portion 56 and hitting the top portion 68 of the curved portion 58 positioned in front of the outer side portion 56 is curved relatively smoothly along the top portion 68, and is returned toward the intermediate part 66 side. At this time, as indicated by the arrow F1, an angle $\alpha$ formed between the flow returning toward the end portion 66*a* of the intermediate part 66 from the top portion 68 and the surface 66*b* of the intermediate part 66, on the inner side portion side, tends to be an acute angle, and the flow as indicated by the arrow F1 may easily be caused to be along the surface 66*b*. Accordingly, the flush water may be suppressed from being separated, as indicated by the arrow F2, on the inner side portion 60 side of the intermediate part 66, and a flow along the surface 66*b*, as indicated by the arrow F3, may easily be formed. Accordingly, a flow that is relatively strong and that is adjusted may easily be formed inside the inner side portion 60 and on the downstream side.

Additionally, if the top portion 68 of the curved portion 58 as described above is not formed at a predetermined position, a flow that is curved along the top portion 68 and that is returned toward the intermediate part 66 side is not easily formed, or a flow that separates from the surface 66*b* of the intermediate part 66, on the inner side portion 60 side, at the time of the flush water circulating around the end portion 66*a* of intermediate part 66 is easily formed, and thus, the flow tends not to follow along the surface 66*b*, and the flow of the flush water is easily disturbed inside the inner side portion 60. In the present embodiment, the top portion 68 having a predetermined shape is formed at a predetermined position of the curved portion 58, and thus, disturbance of the flush water may be reduced, and desirable advantageous effects may be obtained.

Next, an action of the flush toilet 1 according to the embodiment of the present disclosure described above will be described.

First, with the flush toilet 1 according to the embodiment of the present disclosure, the rim spout portion 14 forms, on the downstream end of the rim water passage 46, the rim spout port portion 48 that discharges flush water rearward, and the rim water passage 46 includes the outer side portion 56 that extends forward inside the rim portion 10, the curved portion 58 that is curved inward from the downstream end of the outer side portion 56, and the inner side portion 60 that extends rearward from the curved portion 58 to the rim spout port portion 48. On the rim water passage 46 that faces forward and is then curved to face rearward, the curved portion 58 includes the top portion 68 that is at a position farthest from the intermediate part 66 provided between the inner side portion 60 and the outer side portion 56 in the top view, in a direction extending the intermediate part 66, the top portion 68 being formed in more the outer side portion 56 side than the virtual center line F that extends along the center of the intermediate part 66. Accordingly, it is possible to suppress reduction in the force of water and disturbance in the flow that are caused by occurrence of a pressure loss that is caused when a flow that is curved is separated from the surface, of the intermediate part 66, on the inner side portion 60 side when the flush water flowing forward inside the rim portion 10 is relatively sharply curved to flow backward, and it is also possible to suppress reduction in the force of flow of water discharged from the rim spout port portion 48 into the bowl 8 and to discharge water while adjusting the flow. Accordingly, flushing performance for the bowl 8 may be increased in the case where flush water is discharged rearward into the bowl from the rim spout portion 14 after passing through the rim water passage 46 that faces forward and is then curved to face rearward.

Next, with the flush toilet 1 according to the embodiment of the present disclosure, the top portion 68 is formed into an arc shape in the top view, and thus, the flush water may be curved along the top portion 68 relatively smoothly, and it is possible to better suppress reduction in the force of water and disturbance in the flow that are caused by occurrence of a pressure loss at the top portion 68, and it is also possible to better suppress reduction in the force of flow of water discharged from the rim spout port portion 48 into the bowl 8 and to discharge water while adjusting the flow. Accordingly, flushing performance for the bowl 8 may be even more increased in the case where flush water is discharged rearward into the bowl 8 from the rim spout portion 14 after passing through the rim water passage 46 that faces forward and is then curved to face rearward.

Furthermore, with the flush toilet 1 according to the embodiment of the present disclosure, the curvature radius of the intermediate part 66, at the end portion on the curved portion 58 side, is smaller than the curvature radius of the top portion 68. Thus, when a flow of flush water curved at the top portion 68 flows to the inner side portion 60 side from the end portion of the intermediate part 66, it is possible to better suppress reduction in the force of water and disturbance in the flow that are caused by a pressure loss by separating a flow which returns from the top portion 68 toward the end portion of the intermediate part 66 from the surface on the inner side portion 60 side of the intermediate part 66. Also, the flush water is enabled to easily flow along the surface on the inner side portion 60 side of the intermediate part 66, and reduction in the force of flow of water discharged from the rim spout port portion 48 into the bowl 8 may be better suppressed, and moreover, water may be discharged with a better adjusted flow. Accordingly, flushing performance for the bowl 8 may be even more increased in the case where flush water is discharged rearward into the bowl 8 from the rim spout portion 14 after passing through the rim water passage 46 that faces forward and is then curved to face rearward.

Furthermore, with the flush toilet 1 according to the embodiment of the present disclosure, the outer side portion 56 of the rim water passage 46 is formed to extend more forward than the intermediate part 66, and is formed to extend more forward than the inner side portion 60, and thus, compared to a case where the outer side portion 56 is not formed to extend more forward than the intermediate part 66, the flow channel cross-sectional area of the curved portion 58 may be made relatively large, and a change in the flow channel cross-sectional area from the outer side portion 56 to the inner side portion 60, via the curved portion 58, may be suppressed. Accordingly, it is possible to better suppress reduction in the force of water and disturbance in the flow that are caused by a pressure loss occurring when the flow from the outer side portion 56 reaches the inner side portion 60 via the curved portion 58, and also, reduction in the force of flow of water discharged from the rim spout port portion 48 into the bowl 8 may be better suppressed, and moreover, water may be discharged with a better adjusted flow.

Furthermore, with the flush toilet 1 according to the embodiment of the present disclosure, the outer side portion 56 of the rim water passage 46 includes the curved-portion-side linear portion 56*c* that is connected to the curved portion 58, and the inner side portion 60 of the rim water passage 46 includes the spout-port-side linear portion 60*c* that is connected to the rim spout port portion 48. Accordingly, compared to a case where the outer side portion 56 and the inner side portion 60 are formed as curved portions, it is possible to better suppress reduction in the force of water and disturbance in the flow that are caused by a pressure loss occurring when the flow passes through the outer side portion 56 and the inner side portion 60. Also, reduction in the force of flow of water discharged from the rim spout port portion 48 into the bowl 8 may be better suppressed, and moreover, water may be discharged with a better adjusted flow.

Furthermore, with the flush toilet 1 according to the embodiment of the present disclosure, because the horizontal width of the inner side portion 60 in the top view is greater than the horizontal width of the outer side portion 56 in the top view, when the flush water flows from the outer side portion 56 into the inner side portion 60 via the curved portion 58, the flush water is able to smoothly flow into the inner side portion 60 with a greater horizontal width than the outer side portion 56. Thus, it is possible to better suppress reduction in the force of water and disturbance in the flow that are caused by a pressure loss, and also, reduction in the force of flow of water discharged from the rim spout port portion 48 into the bowl 8 may be better suppressed, and moreover, water may be discharged with a better adjusted flow.

What is claimed is:

1. A flush toilet for discharging waste with flush water supplied from a flush water supply source, the flush toilet comprising:

a bowl including a waste receiving surface that is bowl-shaped, and a rim portion that is formed in a top edge of the waste receiving surface;

a discharge conduit that is connected below the bowl to discharge waste; and a rim spout portion configured to discharge flush water supplied from the flush water supply source into the bowl and form a circulating flow inside the bowl, wherein the rim spout portion is provided in the rim portion on one of left and right sides of the bowl, and the rim spout portion forms a rim water passage where the flush water that is supplied flows through, and forms, on a downstream end of the rim water passage, a rim spout port portion that discharges the flush water rearward, the rim water passage includes an outer side portion that extends forward inside the rim portion, a curved portion that is curved inward from a downstream end of the outer side portion, and an inner side portion that extends rearward from the curved portion to the rim spout port portion, and the curved portion includes a top portion that is at a position farthest from an intermediate part provided between the inner side portion and the outer side portion in a top view, in a direction extending the intermediate part, the top portion being formed into an arc shape in the top view in more the outer side portion side than a virtual center line that extends along a center of the intermediate part, and a curvature radius of the intermediate part, at an end portion on the curved portion side, is smaller than a curvature radius of the top portion, and wherein the top portion is at a position farthest from a front end portion of the intermediate part which is located on the virtual center line that extends along the center of the intermediate part provided between the inner side portion and the outer side portion in the top view, in the direction extending the intermediate part, the curved portion is positioned in a front region more forward than a central transversal line of the bowl, and a horizontal width of the inner side portion in the top view is greater than a horizontal width of the outer side portion in the top view, at a position near the end portion on the curved portion side of the intermediate part.

2. The flush toilet according to claim 1, wherein the outer side portion of the rim water passage is formed to extend more forward than the intermediate part, and is formed to extend more forward than the inner side portion.

3. The flush toilet according to claim 1, wherein the outer side portion of the rim water passage includes a curved-portion-side linear portion that is connected to the curved portion, and the inner side portion of the rim water passage includes a spout-port-side linear portion that is connected to the rim spout port portion.

* * * * *